US009856627B2

(12) United States Patent
Copeland et al.

(10) Patent No.: US 9,856,627 B2
(45) Date of Patent: Jan. 2, 2018

(54) REMOTELY ACTUATED SWING LOCKING MECHANISM FOR MACHINERY WITH ROTATABLE UPPER WORKS

(71) Applicant: Tadano Mantis Corporation, Franklin, TN (US)

(72) Inventors: Daniel Copeland, Franklin, TN (US); Daniel Denney, College Grove, TN (US); Tony Casassa, Franklin, TN (US)

(73) Assignee: Tadano Mantis Corporation, Franklin, TN (US)

( * ) Notice: Subject to any disclaimer, the term of this patent is extended or adjusted under 35 U.S.C. 154(b) by 693 days.

(21) Appl. No.: 14/193,538

(22) Filed: Feb. 28, 2014

(65) Prior Publication Data

US 2015/0247303 A1 Sep. 3, 2015

(51) Int. Cl.
*B66C 23/94* (2006.01)
*E02F 9/12* (2006.01)
(Continued)

(52) U.S. Cl.
CPC ..... *E02F 9/125* (2013.01); *B66C 23/84* (2013.01); *B66C 23/94* (2013.01); *E05B 51/02* (2013.01); *Y10T 403/60* (2015.01)

(58) Field of Classification Search
CPC ..... B66C 23/84; B66C 23/86; B66C 23/94; E02F 9/121; E02F 9/125; E05B 51/02;
(Continued)

(56) References Cited

U.S. PATENT DOCUMENTS 3,664,515 A * 5/1972 Orendorff ..... B66C 23/94 104/47
3,972,378 A * 8/1976 Houriez ..... E02F 9/121 180/327
(Continued)

FOREIGN PATENT DOCUMENTS

CN 2249743 Y 3/1997
CN 203451078 U 2/2014
(Continued)

OTHER PUBLICATIONS

Extended European Search Report for EP App No. 15157061.1 dated Jun. 25, 2015, 7 pgs.
(Continued)

*Primary Examiner* — Ryan D Kwiecinski
(74) *Attorney, Agent, or Firm* — Procopio, Cory, Hargreaves & Savitch LLP

(57) ABSTRACT

A locking mechanism for heavy equipment having a first structure moveable relative to a second structure, the locking mechanism having an actuator mechanism, coupled to one of the first structure and the second structure, operable between a deployed position and a retracted position, a biasing member, a carriage member operable between a restricted position, in response to the actuator being in the retracted position, and an extended position. The biasing member is configured to bias the carriage member toward the extended position in response to the actuator mechanism being in a deployed position and the carriage member is configured to prevent relative movement between the first structure and the second structure in the extended position.

20 Claims, 16 Drawing Sheets

(51) Int. Cl.
*E05B 51/02* (2006.01)
*B66C 23/84* (2006.01)

(58) Field of Classification Search
CPC . F03D 7/0248; F16D 63/006; Y10T 74/19637
See application file for complete search history.

(56) References Cited

U.S. PATENT DOCUMENTS 5,176,267 A * 1/1993 Pech ..... B66C 23/84 212/180
6,010,018 A * 1/2000 Pech ..... B66C 23/94 188/31
6,199,442 B1 * 3/2001 Bauer ..... B66C 23/94 188/31
9,181,926 B2 * 11/2015 Sorensen ..... F03D 7/0224
2011/0132119 A1 * 6/2011 Flamm ..... E05L 347/026 74/434
2013/0248303 A1 * 9/2013 Okuno ..... B60T 1/062 188/67
2016/0010694 A1 * 1/2016 Bienfang ..... E02F 3/46 414/744.2
2016/0265609 A1 * 9/2016 Corsetti ..... F16D 41/30

FOREIGN PATENT DOCUMENTS

EP 0869097 10/1998
EP 2565441 3/2013

OTHER PUBLICATIONS

Chinese Office Action issued on Sep. 29, 2017 for Chinese Patent Application No. 2015100916493, 3 pages.
Chinese Search Report for Chinese Application No. 2015100916493 dated Sep. 21, 2017, 2 pages.

* cited by examiner

REMOTELY ACTUATED SWING LOCKING MECHANISM FOR MACHINERY WITH ROTATABLE UPPER WORKS

FIELD

The present disclosure relates generally to cranes and other heavy machinery with rotatably mounted upper works, and more specifically, heavy machinery that may mechanically lock the position of the upper works relative to the lower works on which the upper works are mounted either for specific machine operations, or for equipment transport.

RELATED ART

Related art cranes and other heavy machinery with upper works or structures, such as an operator cabin, are movable relative to the lower works or structure. Such related art heavy machinery may include a mechanism to mechanically lock the position of the upper works relative to the lower works, either for a specific operation or for transport. In the related art, a hole or slot has been formed in the upper works with a corresponding one or more holes or slots also being provided on the lower works. In such a related art mechanism, a pin is inserted to constrain further relative movement when the hole or slot on the upper works is in alignment with one of the holes or slots on the lower works.

According to another related art structure, the upper works may be rotated by driving a pinion gear around a geared race of a slewing bearing attached to the lower works. In such a related art mechanism, a segment of gearing constrained on one end would be inserted into the gear teeth to prevent relative movement. However, these mechanisms require the assistance of a second worker outside of the operator's cabin in coordination with the operator to engage the locking mechanism.

Having a second worker outside the operator cabin to engage the related art locking mechanisms may impose additional operating costs on the use of the heavy equipment. Additionally, this second worker may also face potential safety issues when attempting to engage the related art locking mechanisms.

SUMMARY

A first implementation may include a locking mechanism for heavy equipment having a first structure moveable relative to a second structure, the locking mechanism having an actuator mechanism, coupled to one of the first structure and the second structure, operable between a deployed position and a retracted position, a biasing member, a carriage member operable between a restricted position, in response to the actuator being in the retracted position, and an extended position, wherein the biasing member is configured to bias the carriage member toward the extended position in response to the actuator mechanism being in a deployed position, wherein the carriage member is configured to prevent relative movement between the first structure and the second structure in the extended position.

Another implementation may include a piece of heavy equipment having a first structure and a second structure moveable relative to the first structure; and a locking mechanism mounted on at least one of the first structure and the second structure, the locking mechanism having an actuator mechanism, coupled to one of the first structure and the second structure, operable between a deployed position and a retracted position, a biasing member; a carriage member operable between a restricted position, in response to the actuator being in the retracted position, and an extended position, wherein the biasing member is configured to bias the carriage member toward the extended position in response to the actuator mechanism being in a deployed position, wherein the carriage member is configured to prevent relative movement between the first structure and the second structure in the extended position.

Another implementation may include a method of controlling a locking mechanism for a piece of heavy machinery, the locking mechanism having an actuator mechanism, a biasing member mechanically coupled to the actuator mechanism, and a carriage member mechanically coupled to the biasing member, the method including providing a user input device to a user, receiving a user input signal from the user through the user input device, sending a control signal to the actuator mechanism in response to the received user input signal, wherein the actuator mechanism moves from a retracted position to a deployed position in response receiving the control signal, wherein the movement of the actuator mechanism to a deployed position causes the biasing member to apply a biasing force to bias the carriage member into an extended position.

BRIEF DESCRIPTION OF THE DRAWINGS

One or more example implementations will now be described with reference to the drawings. The drawings and the associated descriptions are provided to illustrate example implementations of the disclosure and not to limit the scope of the disclosure. Throughout the drawings, reference numbers are maintained to indicate correspondence between referenced elements.

DETAILED DESCRIPTION

Figure 1A:
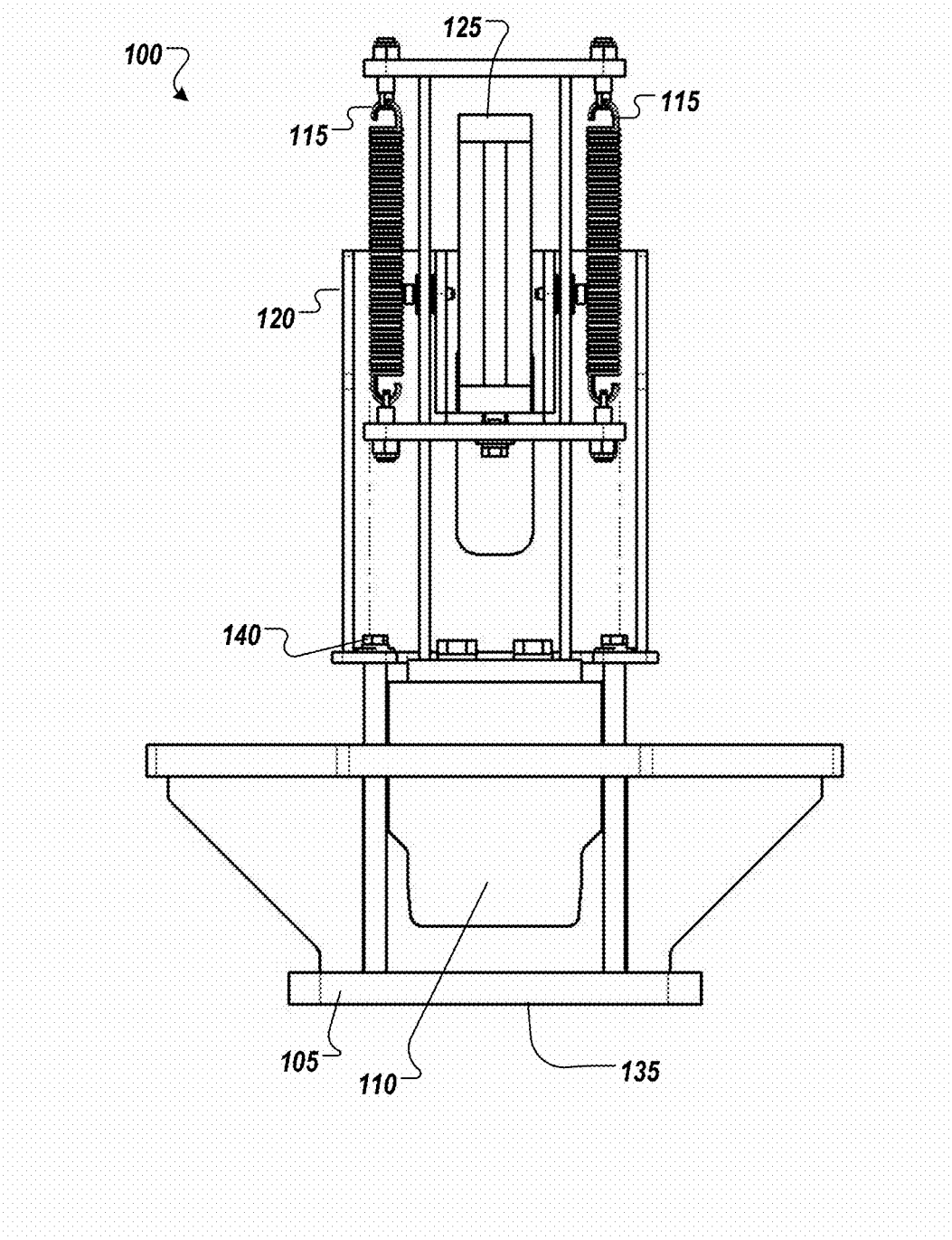
FIG. 1A is front view of a locking mechanism according to a first example implementation in a first position.
Figure 1B:
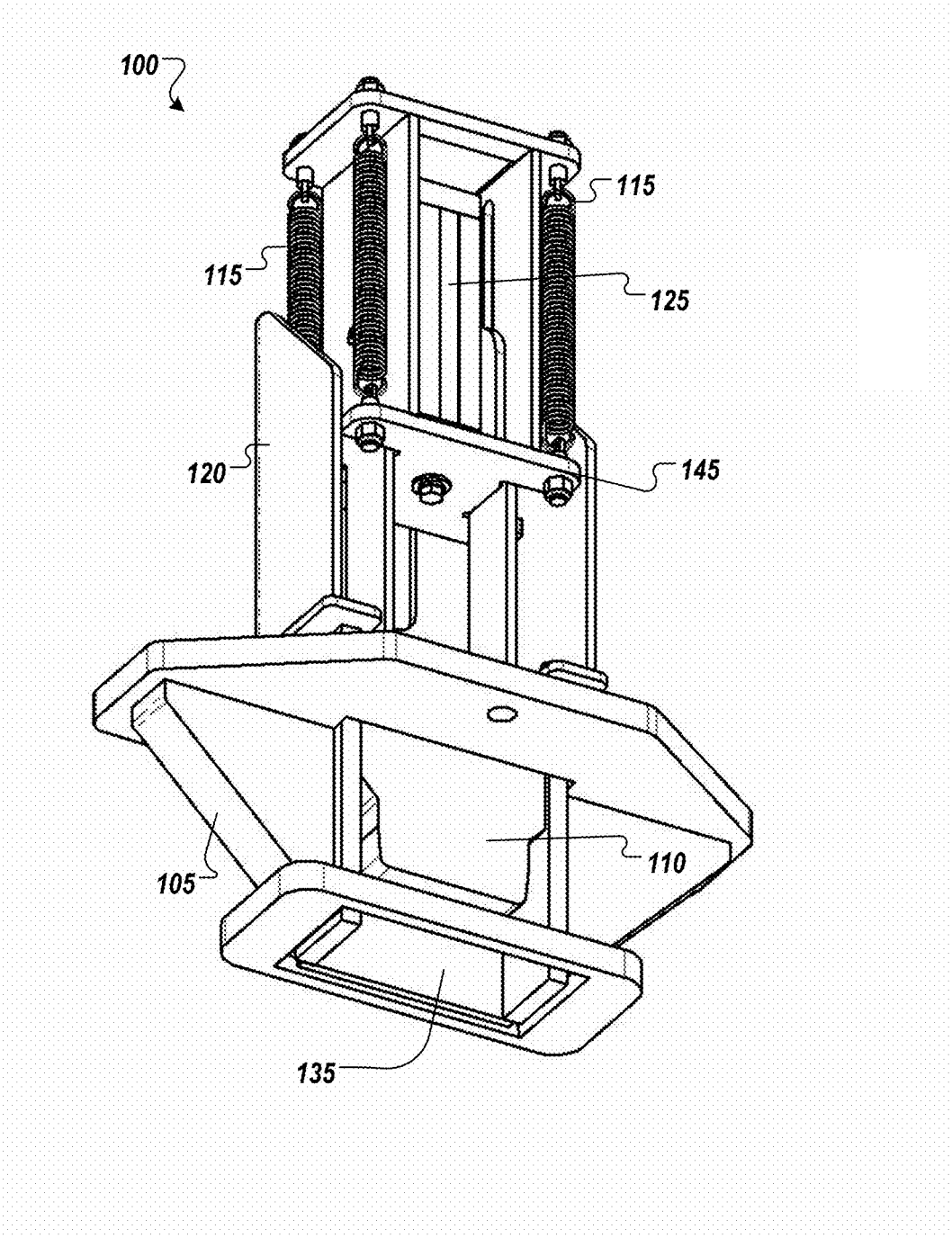
FIGS. 1B and 1C are perspective views of the locking mechanism according to the first example implementation in the first position.
Figure 1C:
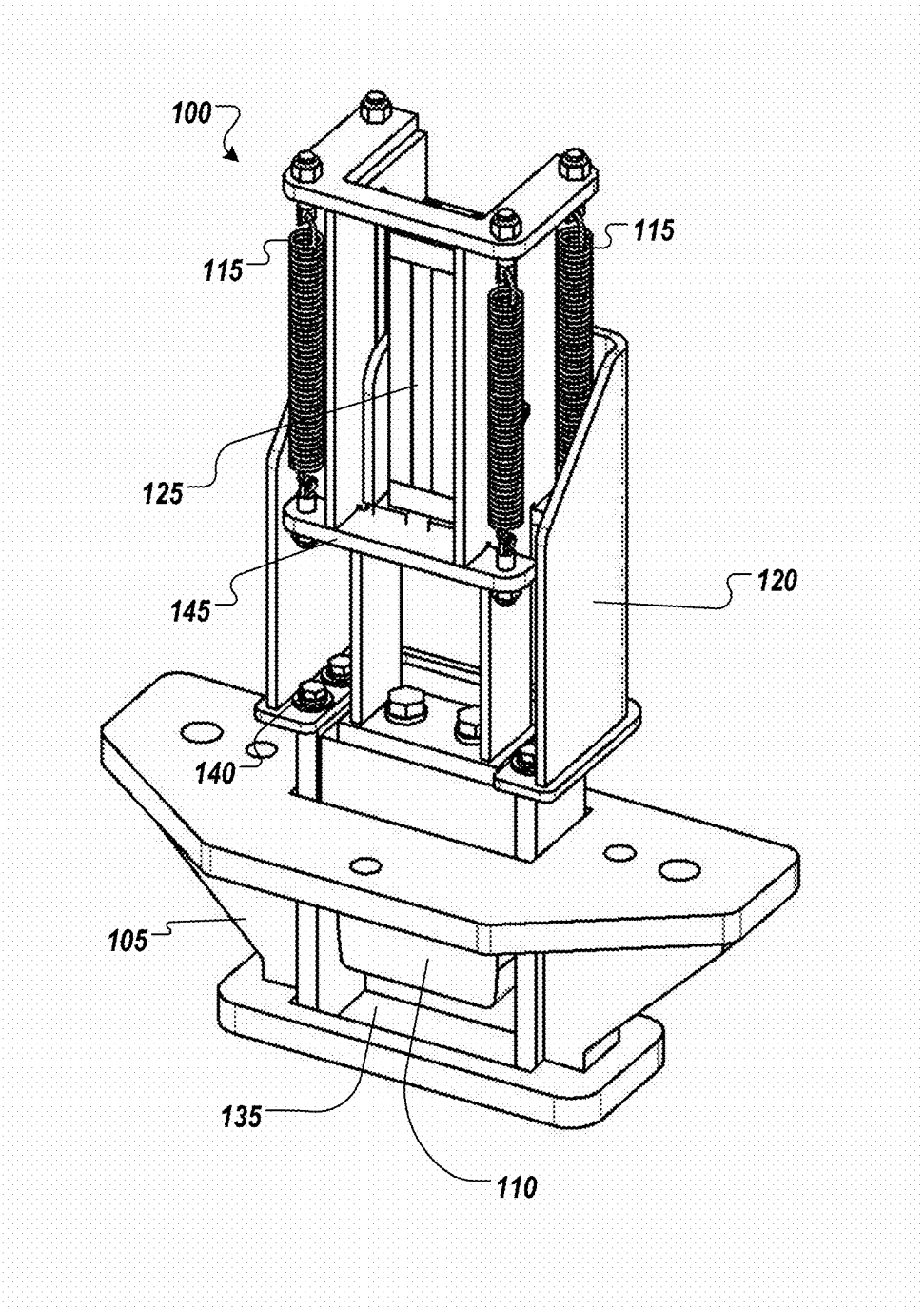

FIG. 1A provides a front view of a locking mechanism 100 according to a first example implementation in a first position, and FIGS. 1B and 1C are perspective views of the locking mechanism 100 according to the first example implementation in the first position. Referring to FIGS. 1A-1C, the locking mechanism 100 includes a lower housing 105, a carriage member 110, one or more biasing members 115, an upper housing 120, and an actuator mechanism 125. The upper housing 102 also be referred to as a "first housing", and the lower housing 105 may also be referred to as a "second housing", or vice versa.

In this example implementation, the lower housing 105 and the upper housing 120 may be formed as separate pieces and are fastened to each other by well-known structures to perform the function of connecting the upper housing 120 to the lower housing 105. For example, bolts 140 may be used. However, example implementations of the present application are not particularly limited to such a configuration and may include a unibody housing or a housing formed from 3 or more pieces. Further, upper housing 120 and lower housing 105 need not be bolted together and may be connected via any fastening mechanism as may be apparent to a person of ordinary skill in the art, including for example, but not by way of limitation, press fitting, welding, adhesive, etc.

As illustrated in FIGS. 1A-1C, the lower housing 105 includes an opening 135 within which the carriage member 110 can be housed. The opening 135 extends through the entire height of the lower housing 105. In some example implementations, the lower housing 105 may function to guide the movement of the carriage member 110 and to provide structural support to the carriage member 110 in an extended position discussed below. However, example implementations of the lower housing 105 need not have an opening 135 that extends through the entire height of the lower housing 105. Further, example implementations of the lower housing 105 need not function to guide the movement of the carriage member 110 or to provide structural support to the carriage member 110.

In some example implementations, the upper housing 120 may function to fix or ground a portion of the actuator 125 to the upper works. For example, in the example implementation of FIGS. 1A-1C, 2A-2C, AND 3A-3C, the actuator mechanism 125 is attached to an upper end (e.g., first end) of the upper housing 120. In this example implementation, an upper end (e.g., first end) of the actuator mechanism 125 is vertically mounted on the upper housing 120. The actuator mechanism 125 is oriented to retract upward into the retracted position shown in FIGS. 1A-1C, and extend downward into a deployed position as shown in FIGS. 2A-3C and discussed below.

The actuator mechanism 125 may be a hydraulic actuator configured to be actuated upward and downward by hydraulic pressure. However, the actuator mechanism 125 is not particularly limited to a hydraulic actuator and may be any structure capable of performing a function of actuating between a retracted and deployed position that may be apparent to a person of ordinary skill in the art including an electronic servo, screw actuator, etc.

A plate 145 is mounted to a lower end (e.g., second end) of the actuator 125. The plate 145 mechanically couples the lower end (e.g., second end) of the actuator mechanism 125 to a lower end (e.g., second end) of the plurality of biasing members 115. Specifically, the plate 145 is attached to the lower end of the actuator mechanism 125 and provides a downward force to the lower end of the biasing members 115 when the actuator mechanism 125 is moved into a deployed position as shown in FIGS. 2A-3C. In this example implementation, each of the biasing members 115 is a coiled spring. However, the biasing members 115 are not limited to coiled springs, but may be structure that can perform the function of biasing, as may be apparent to a person of ordinary skill in the art.

The upper end (e.g., first end) of the biasing members 115 is mechanically coupled to an upper end (e.g., first end) of carriage member 110 such that the biasing members 115 translate the downward force provided by the plate 145 to the carriage member 110 when the actuator mechanism 125 is moved into a deployed position as shown in FIGS. 2A-2C and 3A-3C. In this example implementation, the biasing members 115 may have a spring value sufficient to generate sufficient spring force to draw the carriage member toward a deployed position unless an obstruction interferes with the movement of the carriage member. As used herein "spring value" may refer to the spring stiffness, or k-value from Hooke's Law (i.e. F=kX), which defines the force (F) required to deform the biasing member a proportional distance (X). In some embodiments, the "spring value" (k) of the biasing member may be selected such that the maximum total force ($F_{springmax}$), as defined by the equation 1 below, required to stretch the plurality (n=the number of springs) of biasing members 115 a maximum actuation length ($X_{max}$) of the actuator mechanism 125, is less than the maximum actuation force ($F_{actuator}$) of the actuator mechanism 125.

$$F_{springmax}=n*k*X_{max} \quad \text{(Eq. 1)}$$

Figure 2A:
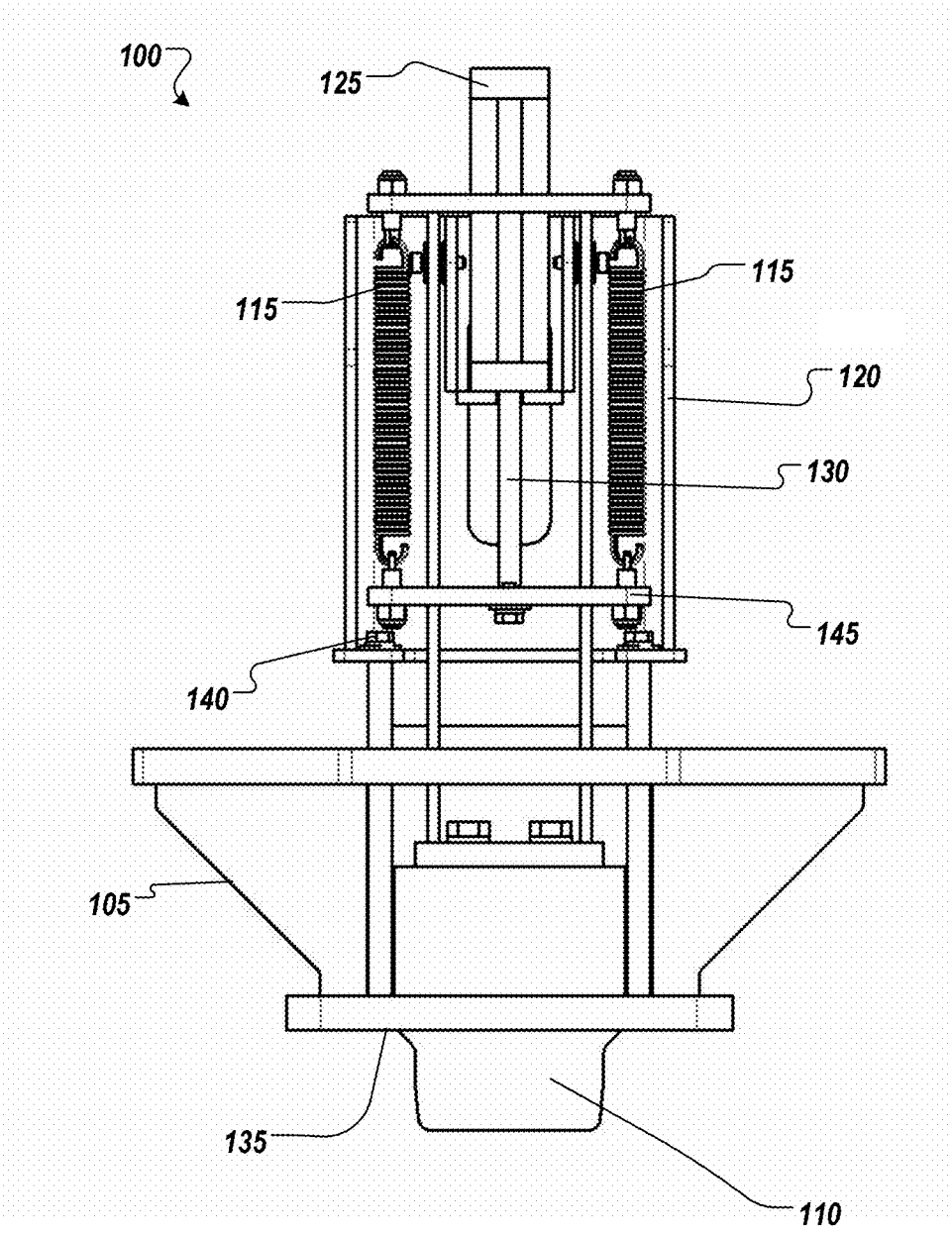
FIG. 2A is front view of a locking mechanism according to a first example implementation in a second position.
Figure 2B:
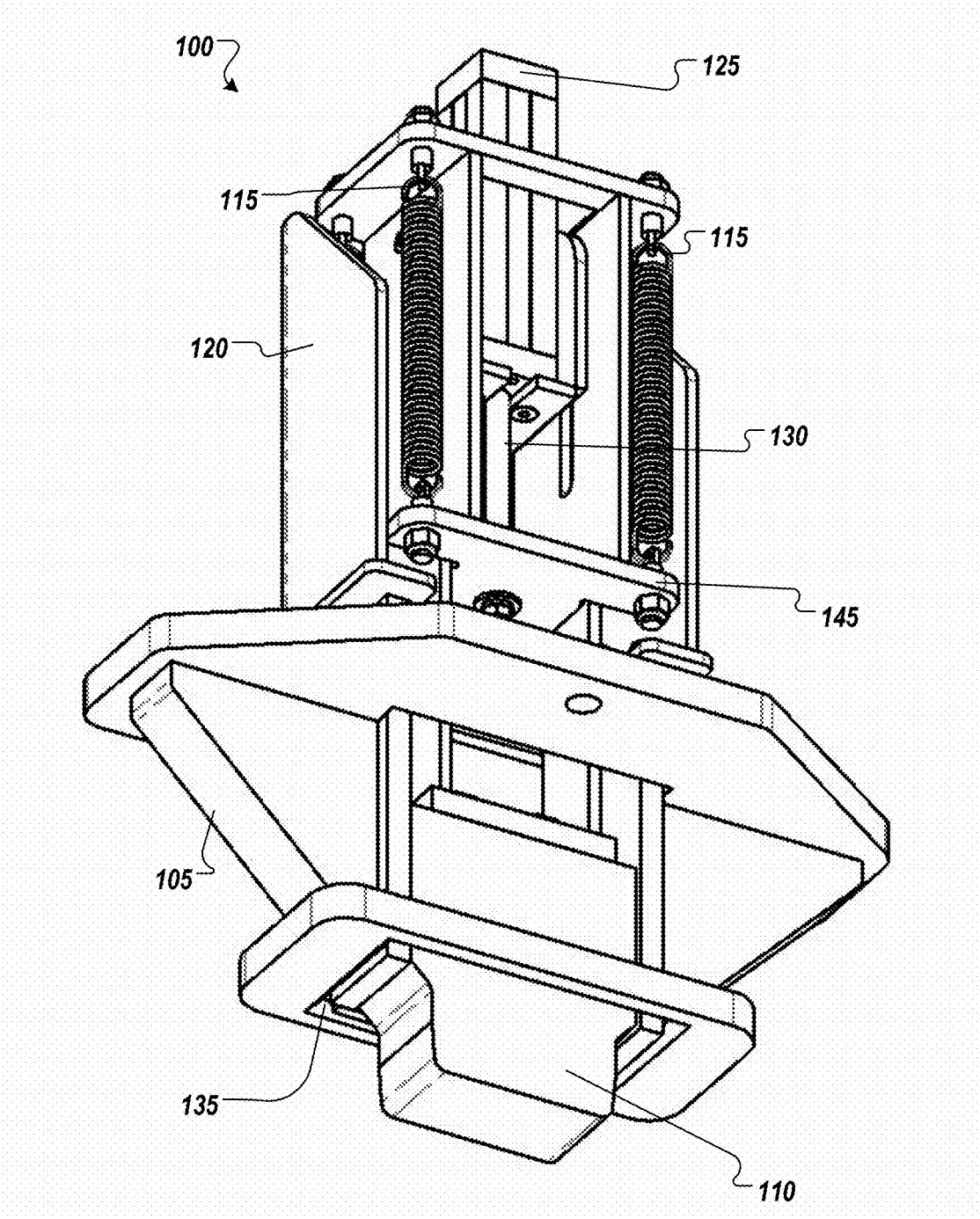
FIGS. 2B and 2C are perspective views of the locking mechanism according to the first example implementation in the second position.
Figure 2C:
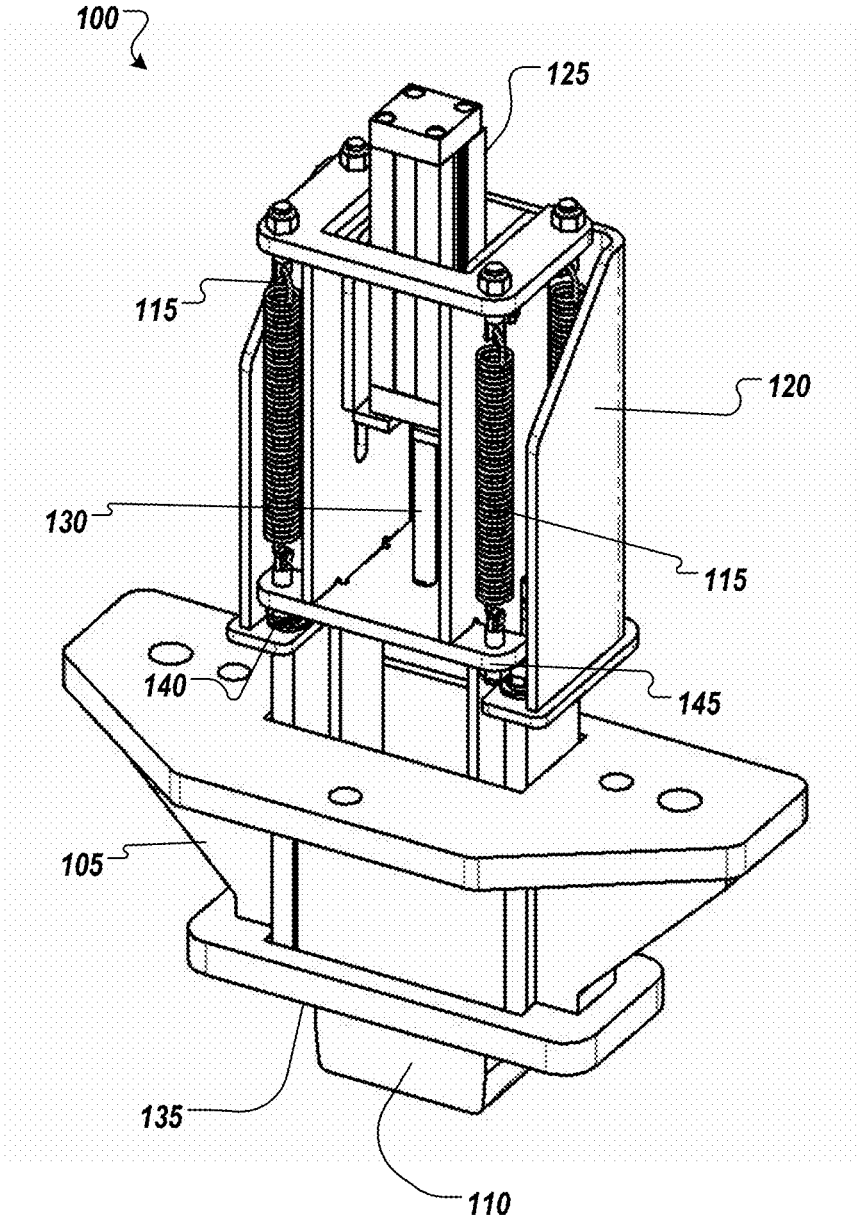

FIG. 2A is front view of the locking mechanism 100 according to a first example implementation in a second position, and FIGS. 2B and 2C are perspective views of the locking mechanism 100 according to the first example implementation in the second position. Further discussion of the structures discussed above with respect to FIGS. 1A-1C is omitted for the sake of conciseness.

Figure 3A:
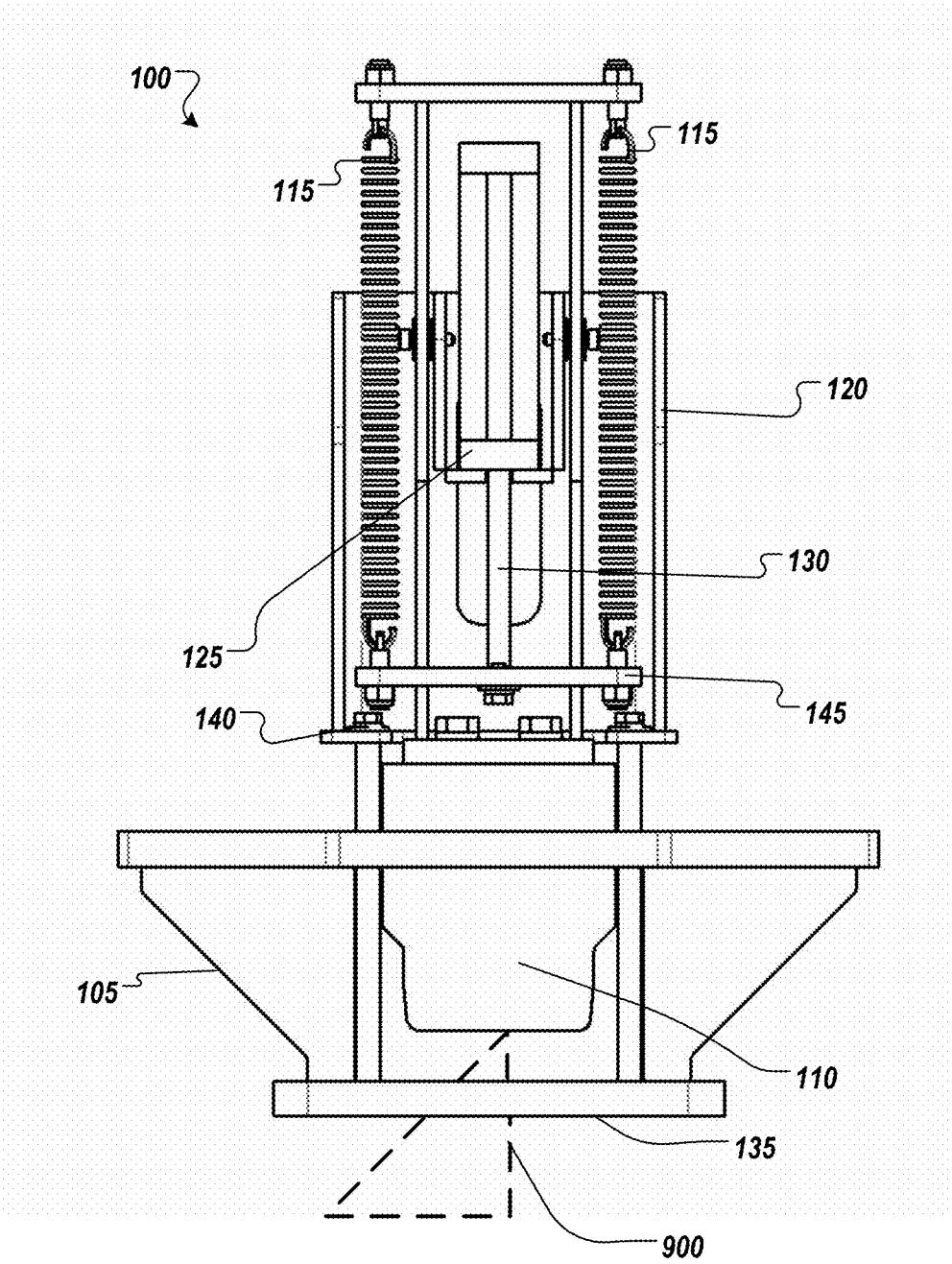
FIG. 3A is front view of a locking mechanism according to a first example implementation in a third position.
Figure 3B:
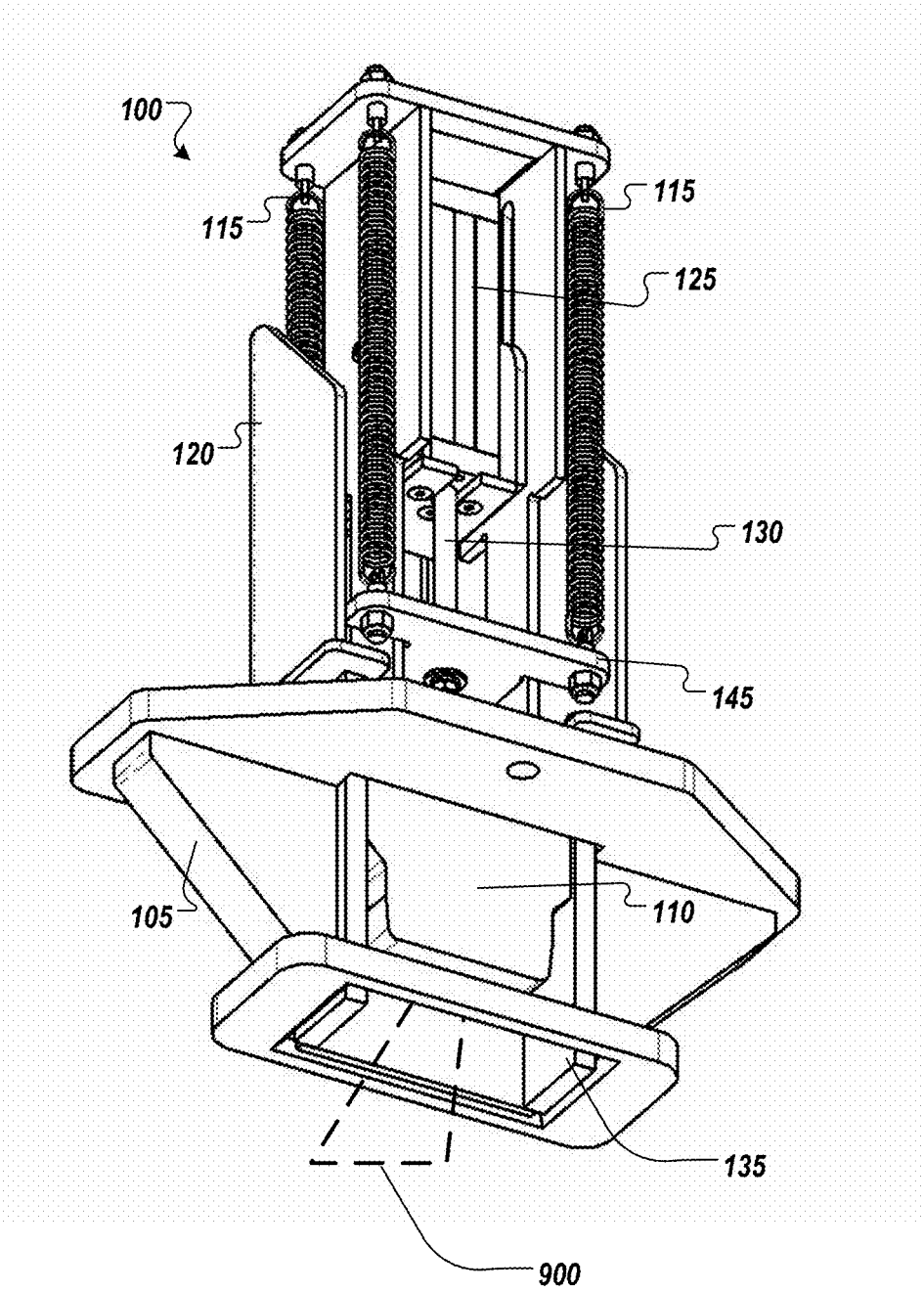
FIGS. 3B and 3C are perspective views of the locking mechanism according to the first example implementation in the third position.
Figure 3C:
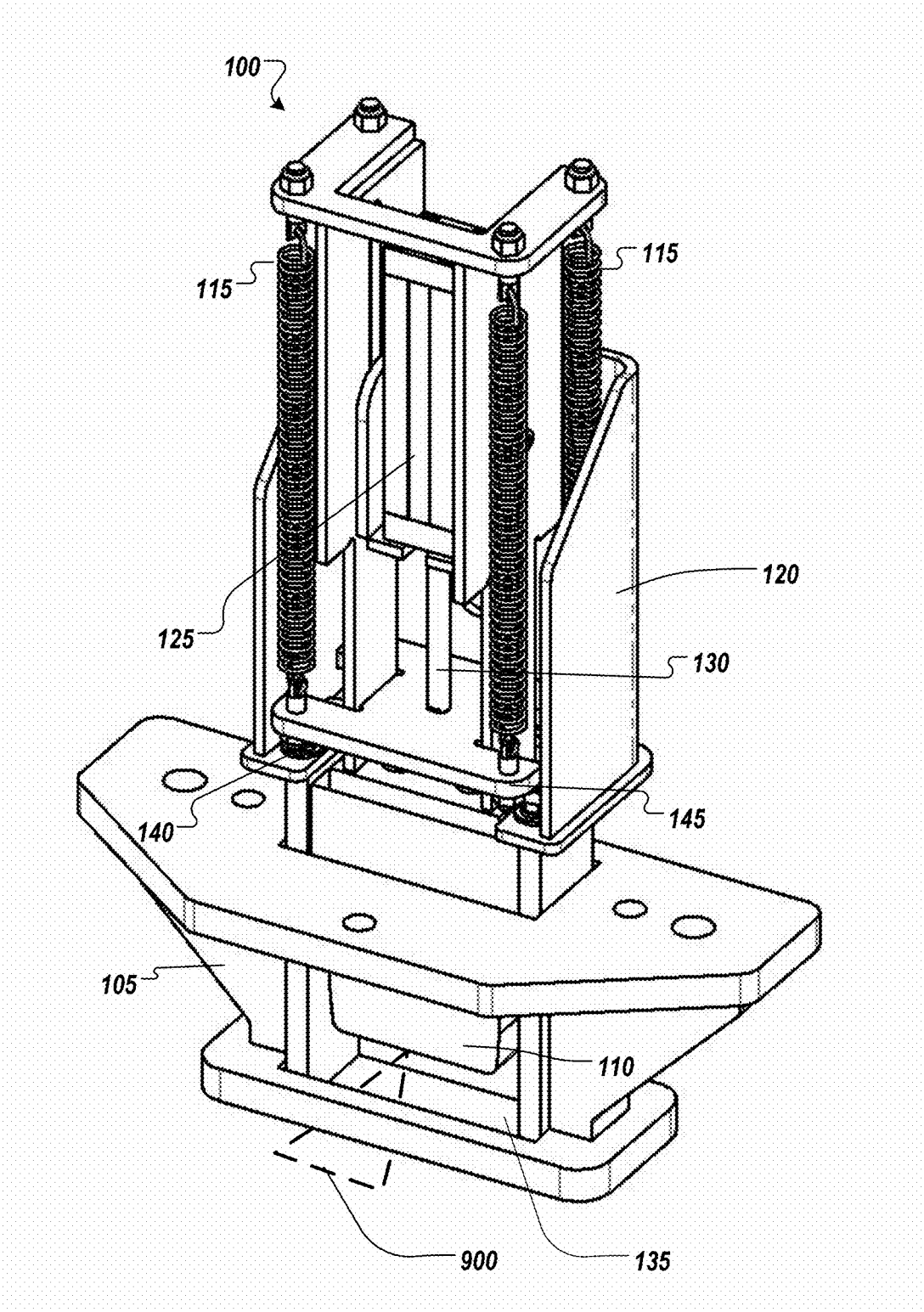

FIGS. 2A-2C illustrate a deployed position of the locking mechanism. In this deployed position, a central cylinder 130 of the actuator mechanism 125 is in a deployed position. In the deployed position, the central cylinder 130 of the actuator mechanism 125 moves the plate 145 and the lower end (e.g., second end) of the biasing members 115 into lowered positions. The biasing members 115 provides a downward force to the carriage member 110, which causes the carriage member 110 to move into an extended position (e.g. extension or feature 900 below the locking mechanism as shown in FIGS. 3A-3C) and protrude through the opening 135 of the lower housing 105 if there is no obstruction restricting the carriage member 110 from achieving the extended position. In this extended position, the carriage member 110 may engage a receiving member as discussed below with respect to FIGS. 4 and 5.

FIG. 3A is front view of the locking mechanism 100 according to a first example implementation in a third position, and FIGS. 3B and 3C are perspective views of the locking mechanism 100 according to the first example implementation in the third position. In this example implementation, the biasing members 115 may have a spring value sufficient to generate sufficient spring force to draw the carriage member toward a deployed position unless an obstruction interferes with the movement of the carriage member. As used herein "spring value" may refer to the spring stiffness, or k-value from Hooke's Law (i.e. F=kX), which defines the force (F) required to deform the biasing member a proportional distance (X). In some embodiments, the "spring value" (k) of the biasing member may be selected such that the maximum total force ($F_{springmax}$), as defined by the equation 1 below, required to stretch the plurality (n=the number of springs) of biasing members 115 a maximum actuation length ($X_{max}$) of the actuator mechanism 125 is less than the maximum actuation force ($F_{actuator}$) of the actuator mechanism 125.

$$F_{springmax}=n*k*X_{max} \quad \text{(Eq. 1)}$$

Specifically, FIGS. 3A-3C illustrate a restrained or restricted position of the locking mechanism where an obstruction 900 prevents the carriage member 10 from extending through the opening 135. The central cylinder 130 of the actuator mechanism 125 had been moved or extended downward, which moves the plate 145 and the lower end (e.g., second end) of the biasing members 115 into lowered positions.

The biasing members 115 again provide a downward force to the carriage member 110. The obstruction 900 prevents the carriage member 110 from extending through the opening 135 causing the biasing members 115 to increase in length, which causes the biasing force to increase proportionally to the increase in length of the biasing member. If the obstruction is sufficient rigid to withstand the increased biasing force, the carriage member 110 will remain in a raised or restricted position as shown in FIGS. 3A-3C. In this raised or restricted position, the carriage member 110 is prevented from engaging the receiving member discussed below with respect to FIGS. 4 and 5.

Figure 4:
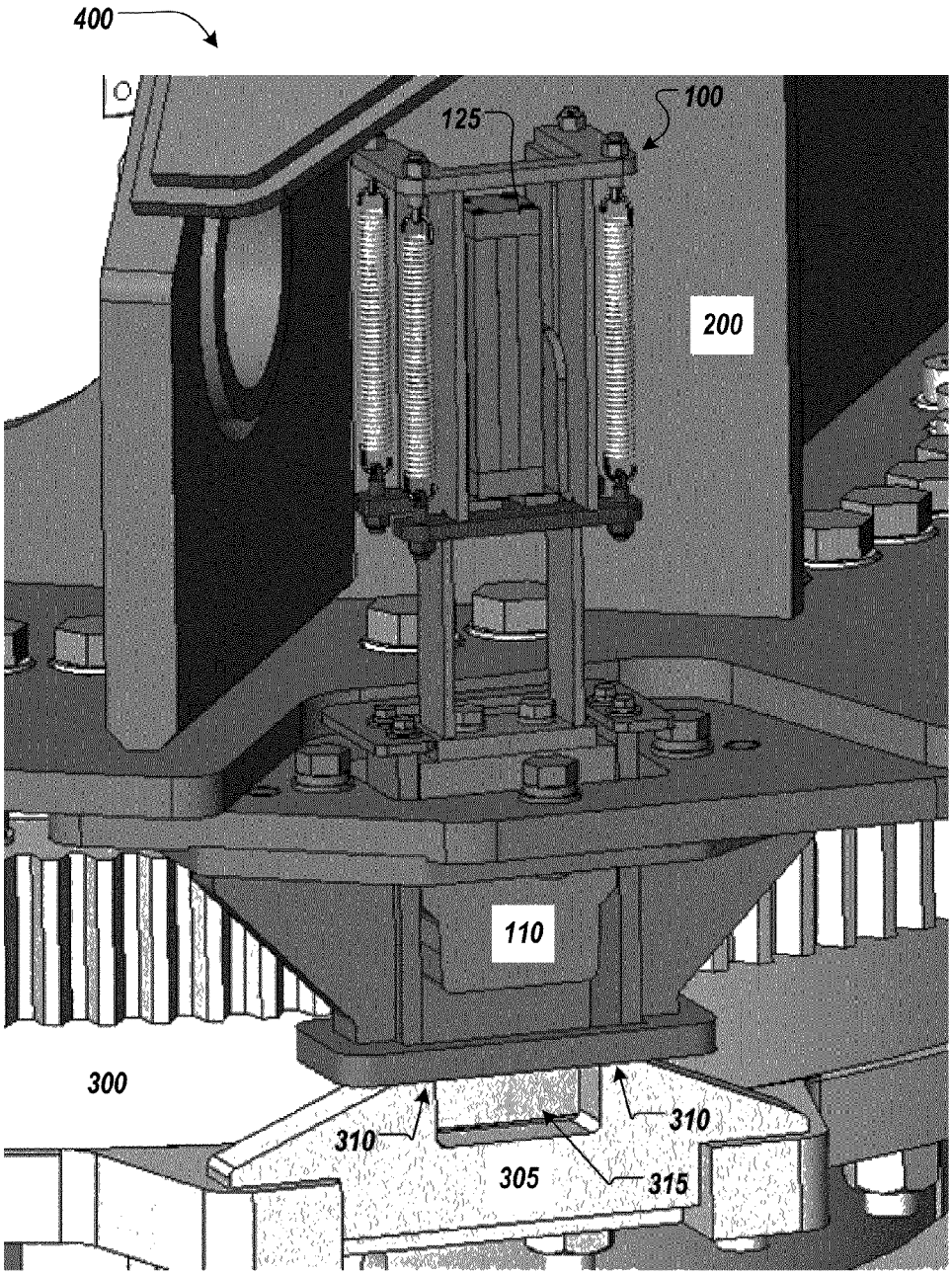
FIG. 4 is a perspective view of a piece of heavy equipment with a locking mechanism according to the first example implementation in a retracted position.
Figure 5:
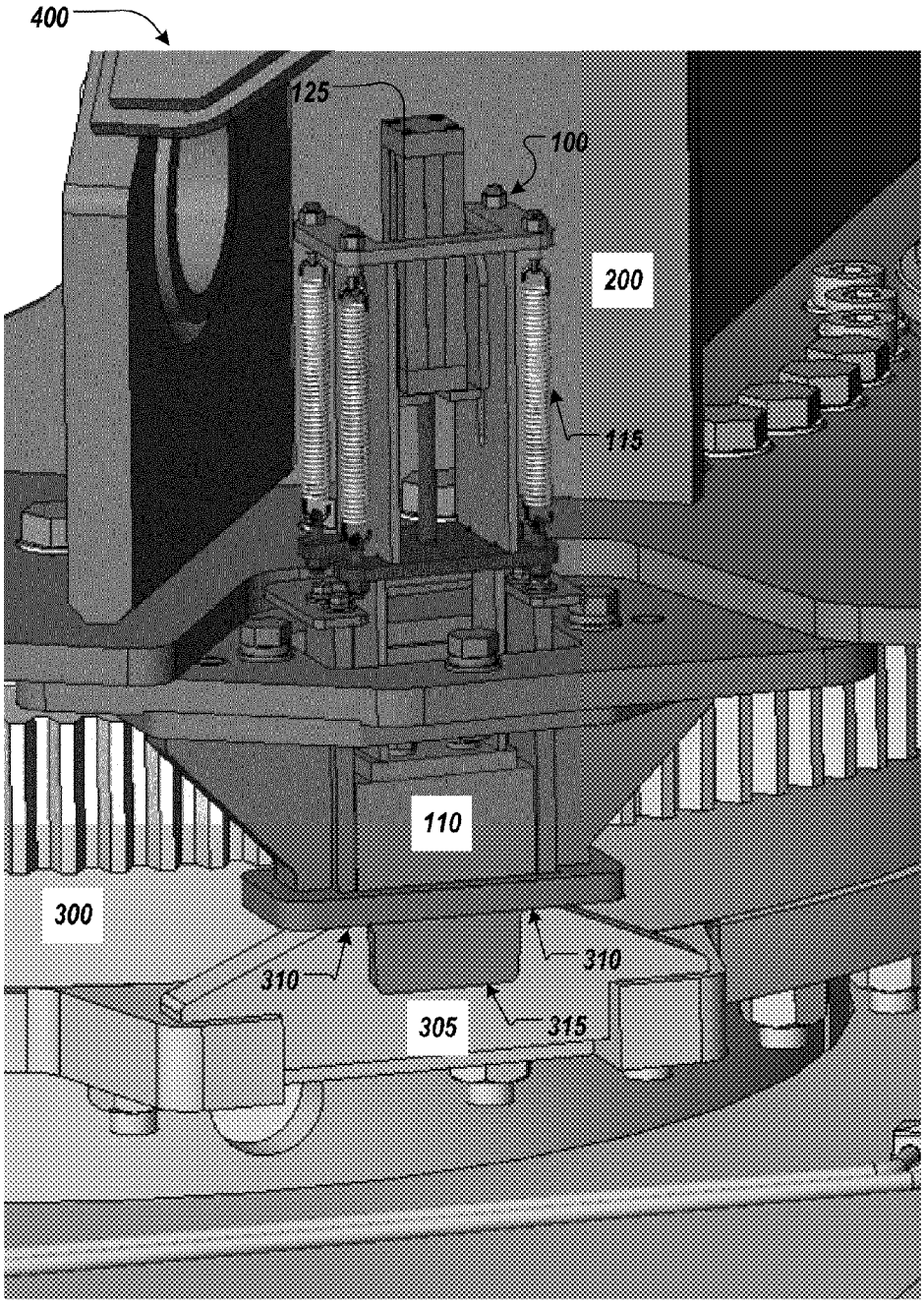
FIG. 5 is a perspective view of a piece of heavy equipment with a locking mechanism according to the first example implementation in an extended position.
Figure 6:
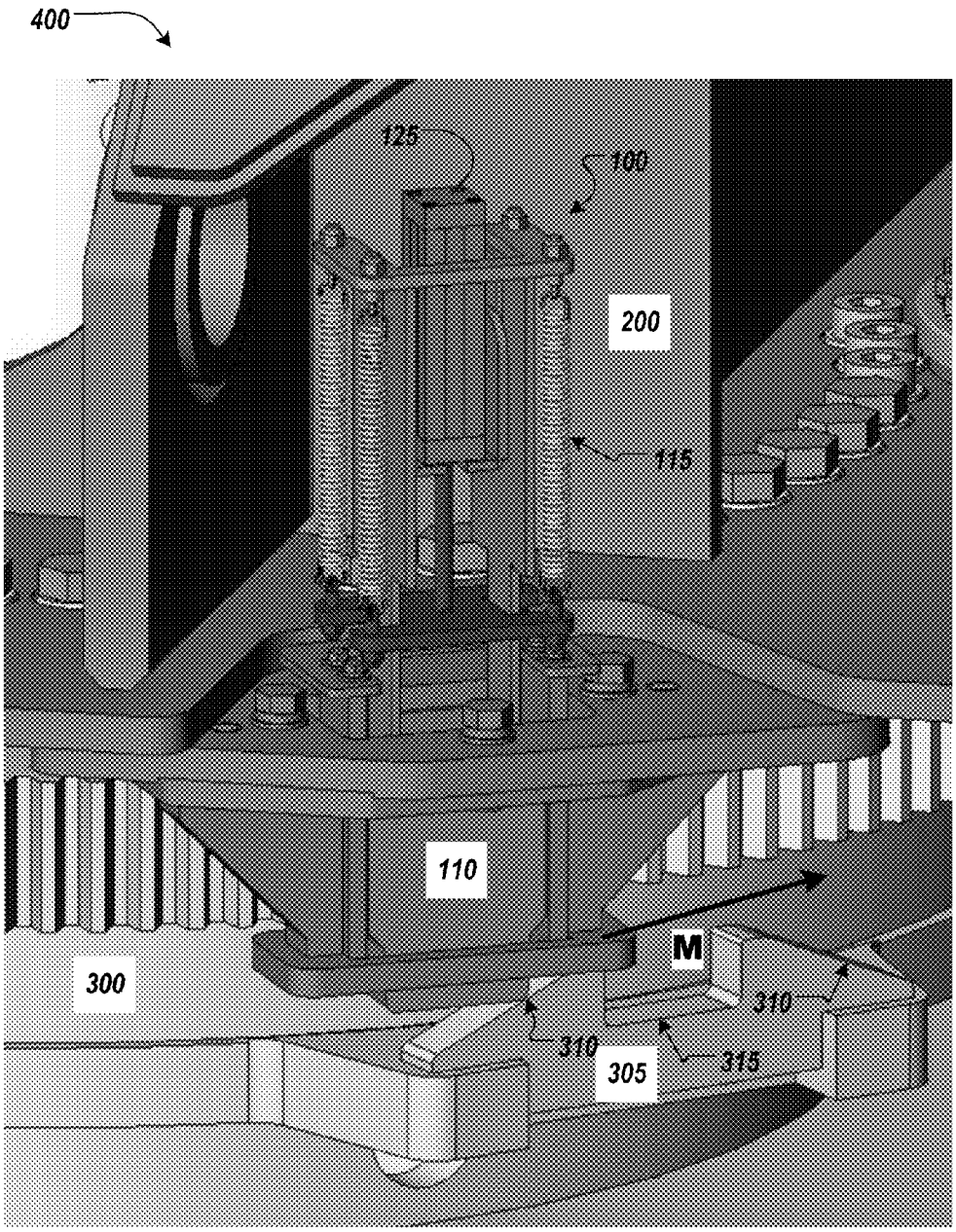
FIG. 6 is a perspective view of a piece of heavy equipment with a locking mechanism according to the first example implementation in a restricted or obstructed position.

FIG. 4 is a perspective view of a piece of heavy equipment 400 with a locking mechanism 100 according to the first example implementation in the retracted position (e.g., as described above with respect to FIGS. 1A-1C). FIG. 5 is a perspective view of the piece of heavy equipment 400 with the locking mechanism 100 according to the first example implementation in an extended position (e.g., as described above with respect to FIGS. 2A-2C). FIG. 6 is a perspective view of a piece of heavy equipment with a locking mechanism according to the first example implementation in a restricted or obstructed position (e.g., as described above with respect to FIGS. 3A-3C). The upper housing 120 is not shown, to avoid obstructing the details of the example implementation. The heavy equipment 400 may be any piece of heavy equipment having an upper works or structure 200 and a lower works or structure 300 movable relative to each other. For example, the heavy equipment 400 may be a construction crane having an upper structure 200 that is configured to rotate relative to the lower structure 300, but is not limited thereto.

In the example implementation shown in FIGS. 4 and 5, the locking mechanism 100 is mounted on the upper works 200 and a receiving member 305 is mounted on the lower works 300. However, example implementations of the present application are not particularly limited to this configuration and the placement of the locking mechanism 100 and the receiving member 305 may be reversed in other example implementations.

In FIGS. 4-5, the receiving member 305 includes a void 315 and a pair of sloped regions 310 adjacent the void 315 extending away from the void 315. However, example implementations of the present application are not particularly limited to this configuration and alternative configurations are possible as may be apparent to a person of ordinary skill in the art.

In FIG. 4, the actuator mechanism 125 is in the upper or retracted position and holds the carriage member 110 in its raised or restricted position as discussed above. In this raised position, the carriage member 110 is held in the opening 135 (shown in FIGS. 1A-1C, 2A-2C, AND 3A-3C, reference numeral omitted in FIG. 4 for clarity) of the lower housing 105 (shown in FIGS. 1A-1C, 2A-2C, AND 3A-3C, reference numeral omitted in FIG. 4 for clarity) and does not engage the receiving member 305 on the lower works 300. Thus, the upper works 200 and the lower works 300 can rotate relative to one another.

In FIG. 5, the central cylinder 130 of the actuator mechanism 125 has been moved or extended into the deployed position. With the central cylinder 130 lowered, a downward force has been applied to the carriage member 110, causing it to travel into the extended position and protrude through the opening 135 (shown in FIGS. 1A-1C, 2A-2C, AND 3A-3C, reference numeral omitted in FIG. 5 for clarity) of the lower housing 105 (shown in FIGS. 1A-1C, 2A-2C, AND 3A-3C, reference numeral omitted in FIG. 5 for clarity).

As illustrated in FIG. 6, if the upper works 200 and the lower works 300 are not aligned such that the opening 135 (shown in FIGS. 1A-1C, 2A-2C, AND 3A-3C, reference numeral omitted in FIG. 5 for clarity) of the lower housing 105 (shown in FIGS. 1A-1C, 2A-2C, AND 3A-3C, reference numeral omitted in FIG. 5 for clarity) is not aligned with the void 315 of the receiving member 305, the carriage member 110 may be prevented from traveling into the extended position (e.g. see FIGS. 2A-2C), and the carriage member 110 may be fully or partially obstructed, for example, by the sloped region 310. In such a configuration the carriage member 110 may be urged upward, against the downward biasing force of the biasing members 115, by the obstruction. In this situation, the carriage member 110 remains in a partial raised or restricted position shown and relative motion between the upper works 200 and lower works 300 may be allowed.

As the upper works 200 and the lower works 300 are moved relative to one another (for example, as illustrated by arrow M in FIG. 6), the carriage member 110 may travel up the slope of the sloped region 315 and be urged further upward into the restricted position, for example as shown in FIGS. 3A-3C. Even though the carriage member 110 is obstructed, the biasing members 115 cause a downward force to continue to be applied to the carriage member 110.

As the upper works 200 and the lower works 300 are further moved relative to one another, the opening 135 (shown in FIGS. 1A-1C, 2A-2C, AND 3A-3C, reference numeral omitted in FIG. 5 for clarity) of the lower housing 105 (shown in FIGS. 1A-1C, 2A-2C, AND 3A-3C, reference numeral omitted in FIG. 5 for clarity) may begin to come into alignment with the void 315. Once the relative movement between the upper works 200 and the lower works 300 causes alignment between the opening 135 (labeled in FIGS. 1A-1C, 2A-2C, AND 3A-3C) of the lower housing 105 (labeled in FIGS. 1A-1C, 2A-2C, AND 3A-3C) mounted on the upper works 200 and the void 315 of the receiving member 305 mounted on the lower works 300, the sloped regions 305 will no longer obstruct the carriage member 100.

With the obstruction no longer present, the biasing force provided by the biasing members 115 will urge the carriage member 110 to extend into the void 315 and be surrounded on both sides by the sloped regions 310 of the receiving member 305 in a pin and hole arrangement, for example, as shown in FIG. 5. Once the carriage member 110 is engaged with the void 315 of the receiving member 305, as illustrated, relative motion between the upper works 200 and the lower works 300 is substantially prevented.

Figure 7:
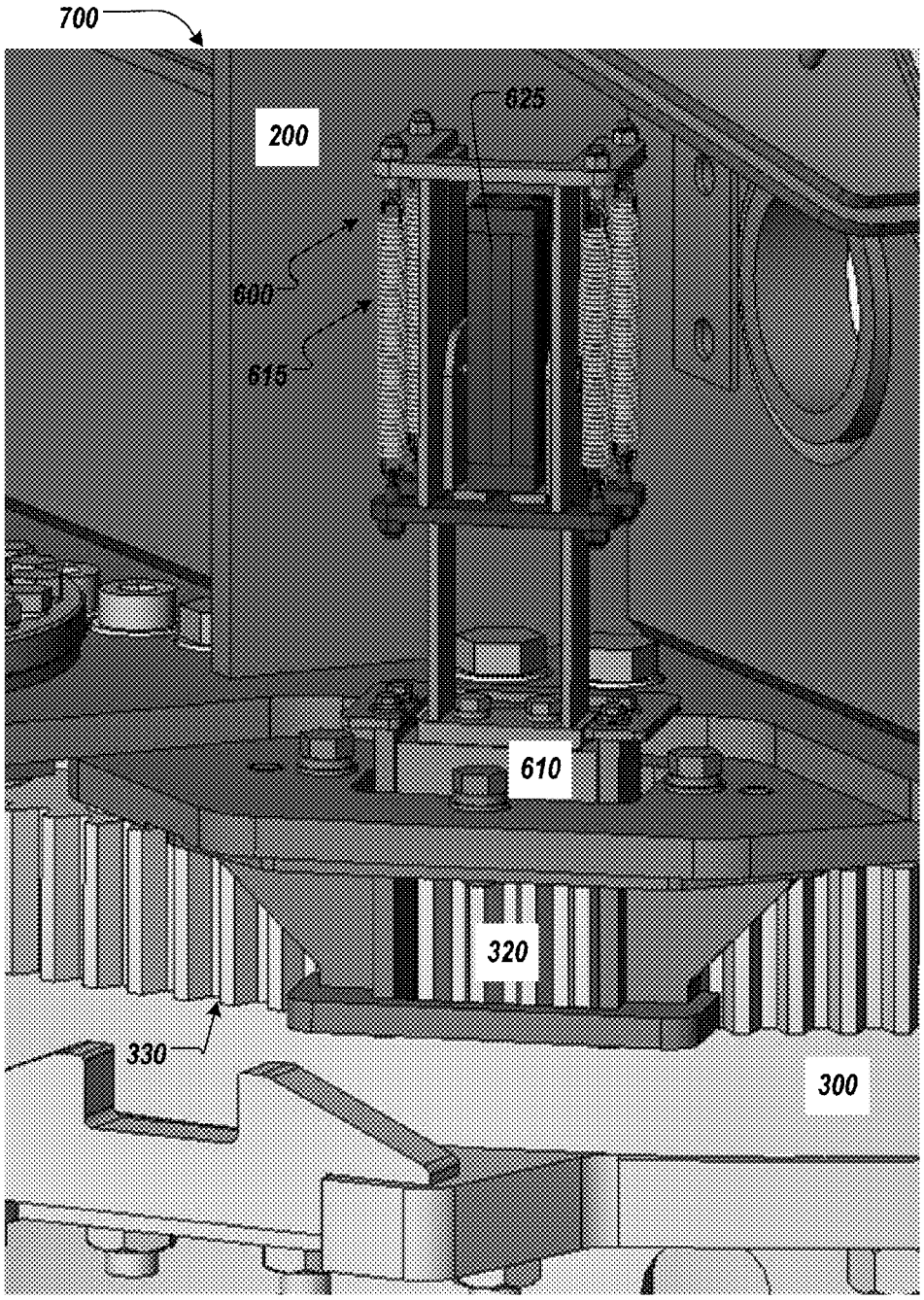
FIG. 7 is a perspective view of a piece of heavy equipment with a locking mechanism according to a second example implementation in a retracted position.
Figure 8:
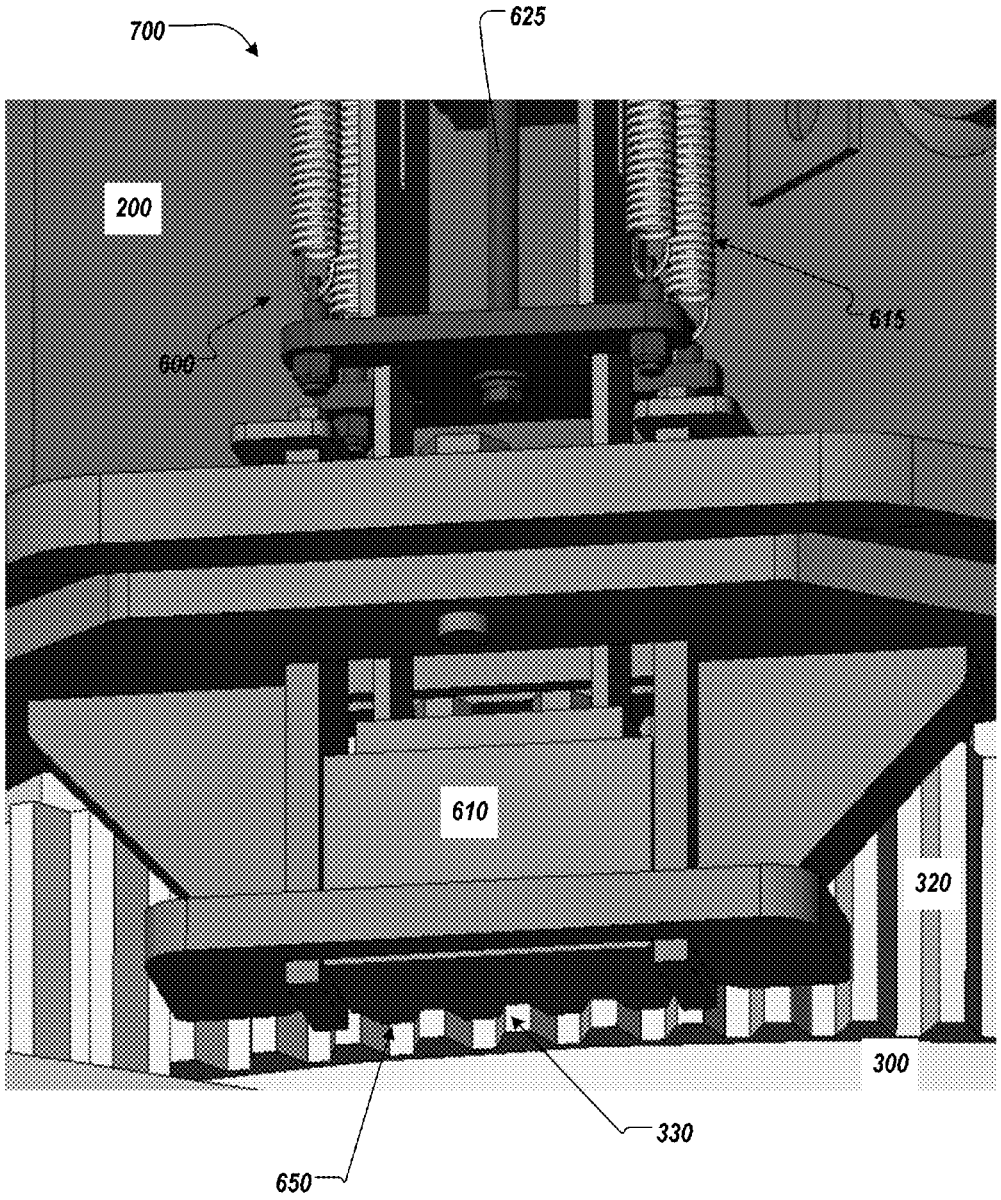
FIG. 8 is a perspective view of a piece of heavy equipment with a locking mechanism according to a second example implementation in an engaged position.
Figure 9:
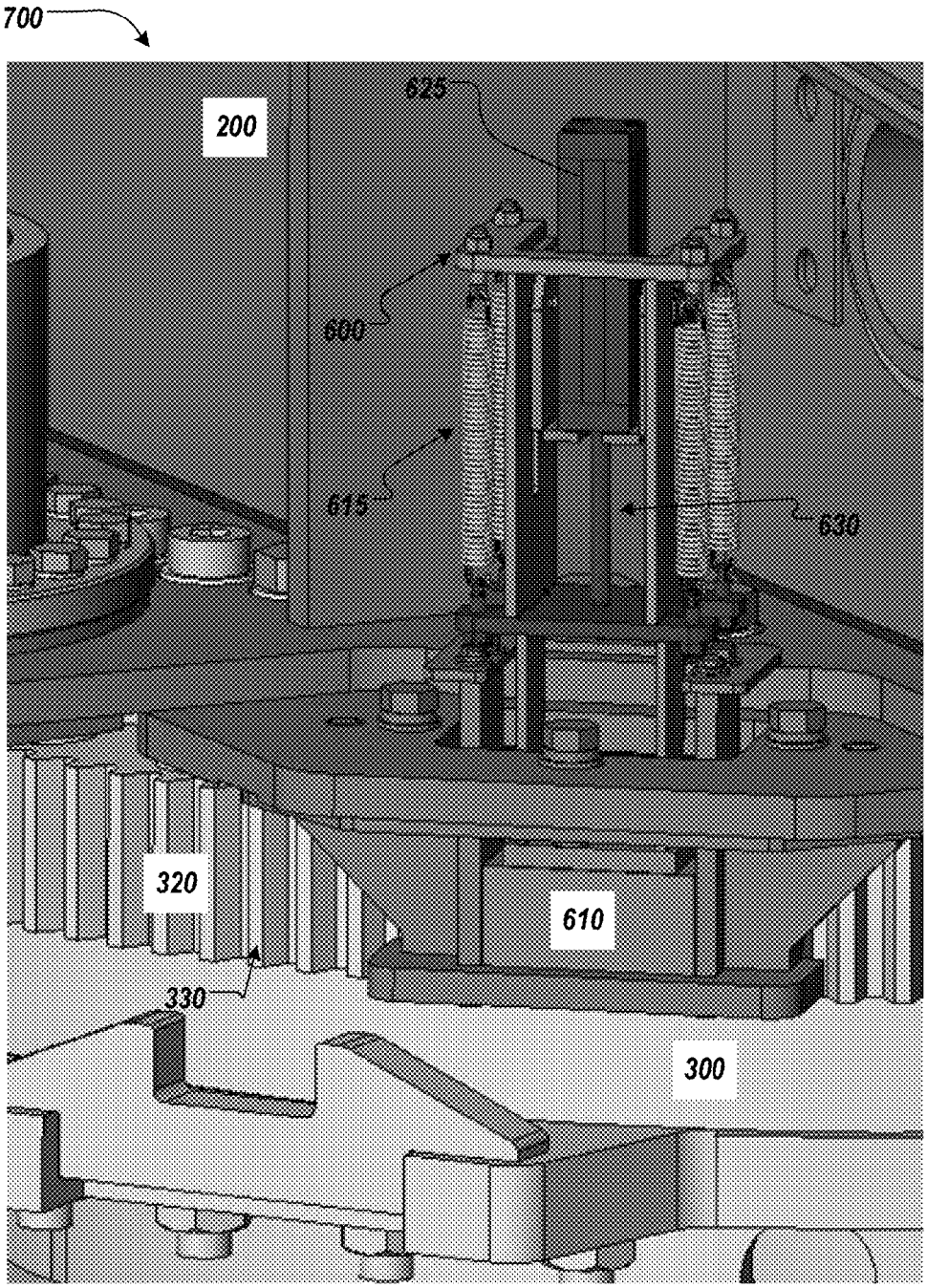
FIG. 9 is a perspective view of a piece of heavy equipment with a locking mechanism according to a second example implementation in a restricted position.

FIG. 7 is a perspective view of a piece of heavy equipment 700 with a locking mechanism 600 according to a second example implementation in a retracted position. FIG. 8 is a perspective view of the piece of heavy equipment 700 with a locking mechanism 600 according to the second example implementation in an engaged position. FIG. 9 is a perspective view of the piece of heavy equipment 700 with a locking mechanism 600 according to the second example implementation in a restricted position. In this example implementation, the heavy equipment 700 may be any piece of heavy equipment having an upper works or structure 200 and a lower works or structure 300 movable relative to each other. For example, the heavy equipment 700 may be a construction crane having an upper structure 200 that is configured to rotate relative to the lower structure 300.

The example implementation in FIGS. 7-9 includes features similar to those discussed above with respect to FIGS. 1-5 above. Similar features are numbered with similar reference numerals.

As illustrated, the locking mechanism 600 is mounted on the upper works 200 and a geared region 320 having a plurality of teeth 330 is provided on the lower works 300 to be engaged by the locking mechanism. For example, the geared region 320 may be formed as a planetary gear or slewing gear. However, example implementations of the present application are not particularly limited to this configuration and the placement of the locking mechanism 600 and the geared region 320 may be reversed or modified in other example implementations.

In this example implementation, the carriage member 610 includes a plurality of teeth 650 configured to align and engage the teeth 330 of the geared region 320 of the lower works 300.

In FIG. 7, the actuator mechanism 625 is an upper or retracted position and holds the carriage member 610 in a raised or restricted position similar to the carriage member 110 discussed above. In this raised position, the carriage member 625 is held in the opening (shown in FIGS. 1A-1C, 2A-2C, AND 3A-3C, reference numeral omitted in FIG. 7 for clarity) of the lower housing (shown in FIGS. 1A-1C, 2A-2C, AND 3A-3C, reference numeral omitted in FIG. 7 for clarity) and does not engage the geared region 320 provided on the lower works 300.

In FIG. 8, the central cylinder 630 of the actuator mechanism 625 has been moved or extended into the deployed position. With the central cylinder 630 lowered, a downward force has been applied to the carriage member 610, causing it to travel into the extended position and protrude through the opening (shown in FIGS. 1A-1C, 2A-2C, AND 3A-3C, reference numeral omitted in FIG. 8 for clarity) of the lower housing (shown in FIGS. 1A-1C, 2A-2C, AND 3A-3C, reference numeral omitted in FIG. 8 for clarity).

In this example implementation, the plurality of teeth 650 of the carriage member 610 aligns with and engages the teeth 330 of the geared region 320 of the lower works 300. Once the teeth 650 of the carriage member 610 engages the teeth 330 of the geared region 320 of the lower works 300 relative motion between the upper works 200 and the lower works 300 is prevented.

However, as illustrated in FIG. 9, if the plurality of teeth 650 of the carriage member 610 do not align with the teeth 330 of the geared region 320 of the lower works 300, the teeth 330 of the geared region 320 obstruct the carriage member 610 from fully extending. In this situation, the carriage member 110 remains in a raised or restricted position similar to the position of the First example implementation shown in FIGS. 3A-3C. In this position, relative motion between the upper works 200 and lower works 300 is allowed.

As the upper works 200 and lower works 300 move relative to each other, the biasing members 615 cause a downward force to be applied to the carriage member 610 even though the carriage member 610 is obstructed. Thus, once the relative movement between the upper works 200 and the lower works 300 causes the plurality of teeth 650 of the carriage member 610 to align with the teeth 330 of the geared region 320 of the lower works 300, the carriage member 610 will move into the extended position and further relative movement between the upper works 200 and the lower works 300 is prevented.

In the above discussed implementations, a single locking mechanism was illustrated. However, implementations of the present application are not limited to having only a single locking mechanism. For example, an implementation may include a plurality of locking mechanism as described in the first implementation shown in FIGS. 1-5. As another example, an implementation may include a plurality of locking mechanisms as described in the second implementation shown in FIGS. 7-9.

Further, an implementation may include one or more locking mechanism as described in the first implementation shown in FIGS. 1-5 in combination with one or more locking mechanisms as described in the second implementation shown in FIGS. 7-9.

Additionally, in some implementations, one or more locking mechanisms as described in the first implementation shown in FIGS. 1-5 may be used to provide coarse locking between the upper works 200 and the lower works 300 (e.g. allow the upper works 200 to be locked at one of four orientations relative to the lower works 300, such as north facing, west facing, south facing, or east facing). In some implementations, one or more locking mechanisms as described in the second implementation shown in FIGS. 7-9 may be used to provide fine locking between the upper works 200 and the lower works 300 (e.g. allow the upper works 200 to be locked at a variety of orientations relative to the lower works 300 based on numbering and spacing of the teeth 650 of the carriage member 610 and the teeth 330 of the geared region 320). Of course other implementations may also be readily apparent to a person of ordinary skill in the art based on the teachings contained herein. Additionally, in an implementation of the present application, a control system configured to execute a process of controlling a locking mechanism as described in any of the implementations of the present application. By way of example, and not by way of limitation, a locking mechanism 100 as described in the first implementation shown in FIGS. 1-5 will be used for the following description of an implementation the process of controlling the locking mechanism. However, other implementations of the locking mechanism may also be used or controlled by a control system as described herein.

Figure 10:
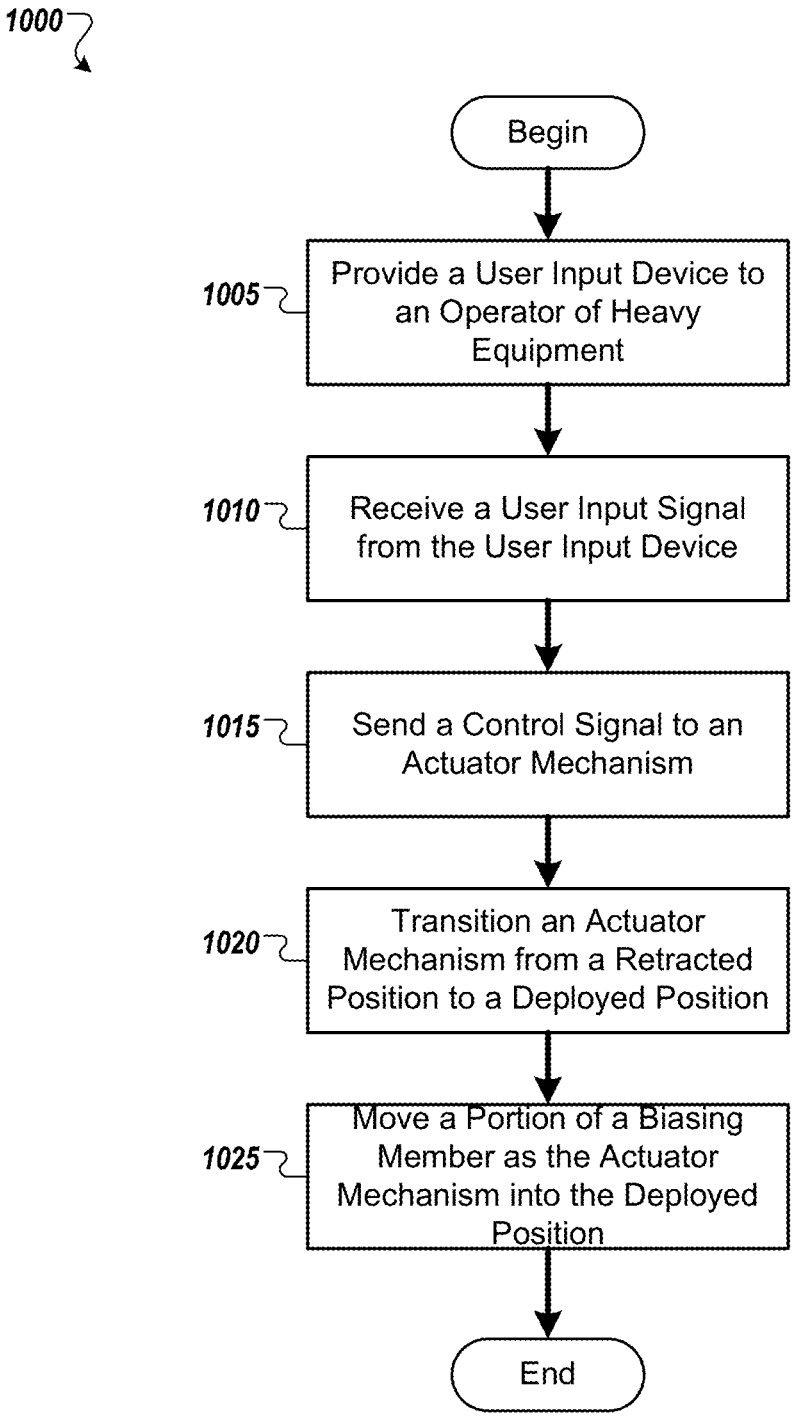
FIG. 10 provides a flow chart showing a process 1000 of controlling a locking mechanism according to an implementation of the present application.

The control system may include a user input device, such as button, switch, dial, touch interface, or any other user input device that may be apparent to a person of ordinary skill in the art. FIG. 10 provides a flow chart showing a process 1000 of controlling a locking mechanism 100 according to an implementation of the present application.

In 1005, the user input device is provided to an operator of the heavy equipment, such as being mounted or made available on a control panel of the heavy equipment. In 1010, a user input signal is received from the operator through the use of the user input device. For example, and not by way of limitation, the operator may press a button, flip a switch, turn a dial, activate a computer interface, touch a touch interface, etc.

In response to the user input signal, the control system may send a control signal to the actuator mechanism 110 of a locking mechanism 100 in 1015. The actuator mechanism may transition from a retracted position to a deployed position in 1020.

As the actuator mechanism 110 of the locking mechanism 100 transitions into the deployed position, an end of the biasing members 115 mechanically coupled to the actuator mechanism 110 is moved in 1025 and the control process ends.

As discussed above, moving an end of the biasing members 115 causes a biasing force to be applied to the carriage member 110 and, if no obstruction, is present the carriage member 110 will be caused to move into an extended position, for example, as illustrated in FIGS. 2A-2C. However, if an obstruction is present, the obstruction will cause the carriage member 110 to remain in the retracted or restricted position, for example, as illustrated in FIGS. 3A-3C.

The example implementation of a control process 1000 illustrated in FIG. 10 describes a process for causing the locking mechanism 100 to be deployed into an extended or locking position, for example, as illustrated in FIGS. 2A-2C. Further, as may be apparent to a person of ordinary skill in the art a similar process may be used to remotely retract the locking mechanism 100 into a retracted or withdrawn position, for example, as illustrated in FIGS. 1A-1C.

Additionally, some example implementations of the structures and processes described herein may also incorporate sensors configured to provide feedback, during operation, to the operator, who likely cannot see the locking mechanism 100. For example, proximity sensors, contact switches, cameras, or any other feedback providing mechanism that may be apparent to a person of ordinary skill in the art, may be provided within or near the locking mechanism to report back to the operator any number of possible pieces of information, such as actuator position (fully extended/fully retracted/any point in between) and/or carriage position (fully restricted/fully deployed/any point between), for example, during operation of the heavy equipment 400.

By providing a locking mechanism according to an implementation of the present application, the need to have a second worker engage the locking mechanism may be advantageously eliminated. Without a second worker, the operating costs associated with the heavy equipment may be reduced. Additionally, there may also be an increase in the safety associated with the operation of the heavy equipment.

The foregoing detailed description has set forth various example implementations of the devices and/or processes via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware.

While certain example implementations have been described, these example implementations have been presented by way of example only, and are not intended to limit the scope of the protection. Indeed, the novel apparatuses described herein may be embodied in a variety of other forms. Furthermore, various omissions, substitutions and changes in the form of the systems described herein may be made without departing from the spirit of the protection. The accompanying claims and their equivalents are intended to cover such forms or modifications as would fall within the scope and spirit of the protection.

What is claimed is:

1. A locking mechanism for heavy equipment having a first structure moveable relative to a second structure, the locking mechanism comprising:

an actuator mechanism, coupled to one of the first structure and the second structure, operable between a deployed position and a retracted position, wherein the actuator mechanism is oriented to extend vertically in the deployed position;

a biasing member, configured to generate a biasing force in response to the actuator mechanism being in a deployed position, wherein the actuator mechanism comprises a cylinder configured to extend toward an other of the first structure and the second structure when the actuator mechanism is in the deployed position, wherein a first, lower portion of the cylinder is coupled to a lower portion of the biasing member; and a carriage member operable between, a vertically extended position directly engaging a receiving member disposed on the other of the first structure and the second structure, in response to the biasing force being generated by the biasing member, so as to prevent relative movement between the first structure and the second structure, wherein the biasing force is proportional to an increase in length of the biasing member and is transmitted to the carriage member by an upper portion of the biasing member coupled to an upper portion of the carriage member, and a restricted position, in response to the actuator being in the retracted position, so as to retain the carriage member in the restricted position and not prevent the relative movement between the first structure and the second structure.

2. The locking mechanism according to claim 1, wherein the carriage member is configured to hold the restricted position against the bias provided by the biasing member when an obstruction blocks the carriage member from extending into the extended position, and wherein the carriage member is configured to move from the restricted position into the extended position with respect to a gap formed by relative movement between the first structure and the second structure.

3. The locking mechanism according to claim 1, wherein the carriage member is mounted on one of the first structure and the second structure, the carriage member comprising a plurality of carriage teeth; and wherein a receiving member is mounted on the other of the first structure and the second structure, the receiving member comprising a plurality of receiving teeth; and wherein the carriage teeth are configured to engage the receiving teeth when the carriage member is in an extended position.

4. The locking mechanism according to claim 1, wherein the carriage member is mounted on one of the first structure and the second structure, the carriage member being a pin member; and wherein the locking mechanism further comprises a receiving member mounted on the other of the first structure and the second structure, the receiving member defining a void configured to receive the pin member when the carriage member is operated into an extended position.

5. The locking mechanism according to claim 1, wherein the actuator mechanism comprises a hydraulic actuator configured to be operable between the deployed position and the retracted position.

6. The locking mechanism according to claim 1, wherein the biasing member comprises a plurality of springs connected between the actuator mechanism and the carriage member.

7. The locking mechanism according to claim 1, wherein the cylinder is configured to extend vertically downward when the actuator mechanism is in the deployed position.

8. The locking mechanism according to claim 7, further comprising a plate mounted to an end of the cylinder and mechanically coupled to the biasing member.

9. The locking mechanism according to claim 8, wherein the plate is mechanically coupled to a first end of the biasing member; and wherein a second end of the biasing member is mechanically coupled to an end of the carriage member.

10. The locking mechanism according to claim 1, wherein the biasing member has a spring value to generate a sufficient biasing force to draw the carriage member toward a extended position unless an obstruction interferes with the movement of the carriage member, and wherein the maximum biasing force ($F_{springmax}$) of the biasing member for a maximum articulation length ($X_{max}$) of the actuator mechanism does not exceed a maximum actuation force ($F_{actuator}$) of the actuator mechanism.

11. The locking mechanism of claim 1, wherein the actuator mechanism is oriented to extend vertically downward in the deployed position.

12. A piece of heavy equipment comprising:

a first structure;

a second structure moveable relative to the first structure; and a locking mechanism mounted on at least one of the first structure and the second structure, the locking mechanism comprising:

an actuator mechanism, coupled to one of the first structure and the second structure, operable between a deployed position and a retracted position, wherein the actuator mechanism is oriented to extend vertically in the deployed position;

a biasing member, configured to generate a biasing force in response to the actuator mechanism being in a deployed position, wherein the actuator mechanism comprises a cylinder configured to extend toward an other of the first structure and the second structure when the actuator mechanism is in the deployed position, wherein a first, lower portion of the cylinder is coupled to a lower portion of the biasing member; and a carriage member operable between, a vertically extended position directly engaging a receiving member disposed on the other of the first structure and the second structure, in response to the biasing force being generated by the biasing member, so as to prevent relative movement between the first structure and the second structure, wherein the biasing force is proportional to an increase in length of the biasing member and is transmitted to the carriage member by an upper portion of the biasing member coupled to an upper portion of the carriage member, and a restricted position, in response to the actuator being in the retracted position, so as to retain the carriage member in the restricted position and not prevent the relative movement between the first structure and the second structure.

13. The piece of heavy equipment according to claim 12, wherein the carriage member is configured to hold the restricted position against the bias provided by the biasing member when an obstruction blocks the carriage member from extending into the extended position, and wherein the carriage member is configured to move from the restricted position into the extended position with respect to a gap formed by relative movement between the first structure and the second structure.

14. The piece of heavy equipment according to claim 12, wherein the carriage member is mounted on one of the first structure and the second structure, the carriage member comprising a plurality of carriage teeth; and wherein a receiving member is mounted on the other of the first structure and the second structure, the receiving member comprising a plurality of receiving teeth; and wherein the carriage teeth are configured to engage the receiving teeth when the carriage member is in an extended position.

15. The piece of heavy equipment according to claim 12, wherein the carriage member is mounted on one of the first structure and the second structure, the carriage member being a pin member; and wherein the locking mechanism further comprises a receiving member mounted on the other of the first structure and the second structure, the receiving member defining a void configured to receive the pin member when the carriage member is operated into an extended position.

16. The piece of heavy equipment according to claim 12, wherein the actuator mechanism comprises a hydraulic actuator configured to be operable between the deployed position and the retracted position.

17. The piece of heavy equipment according to claim 12, wherein the biasing member comprises a plurality of springs connected between the actuator mechanism and the carriage member.

18. The piece of heavy equipment according to claim 12, wherein the cylinder is configured to extend vertically downward when the actuator mechanism is in the deployed position.

19. The piece of heavy equipment according to claim 18, further comprising a plate mounted to an end of the cylinder and mechanically coupled to the biasing member, wherein the plate is mechanically coupled to a first end of the biasing member; and wherein a second end of the biasing member is mechanically coupled to an end of the carriage member.

20. The piece of heavy equipment according to claim 12, wherein the biasing member has a spring value to generate a sufficient biasing force to draw the carriage member toward a extended position unless an obstruction interferes with the movement of the carriage member, and wherein the maximum biasing force ($F_{springmax}$) of the biasing member for a maximum articulation length ($X_{max}$) of the actuator mechanism does not exceed a maximum actuation force ($F_{actuator}$) of the actuator mechanism.

* * * * *